US009810209B2

(12) United States Patent
Kondo et al.

(10) Patent No.: US 9,810,209 B2
(45) Date of Patent: Nov. 7, 2017

(54) COMPRESSOR

(71) Applicant: KABUSHIKI KAISHA TOYOTA JIDOSHOKKI, Aichi-ken (JP)

(72) Inventors: Hisaya Kondo, Kariya (JP); Ai Saeki, Kariya (JP); Yasushi Suzuki, Kariya (JP); Hiroyuki Kobayashi, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 285 days.

(21) Appl. No.: 14/668,127

(22) Filed: Mar. 25, 2015

(65) Prior Publication Data

US 2015/0275885 A1 Oct. 1, 2015

(30) Foreign Application Priority Data

Mar. 27, 2014 (JP) ..... 2014-066325

(51) Int. Cl.
*F04B 27/08* (2006.01)
*F04B 39/10* (2006.01)
(Continued)

(52) U.S. Cl.
CPC ..... *F04B 39/1066* (2013.01); *F04B 27/08* (2013.01); *F04B 27/1804* (2013.01);
(Continued)

(58) Field of Classification Search
CPC ..... F04B 2027/1813; F04B 2027/1827; F04B 27/18; F04B 27/1804
See application file for complete search history.

(56) References Cited

U.S. PATENT DOCUMENTS 5,262,068 A * 11/1993 Bowers ..... B01D 35/26 210/134
5,533,871 A 7/1996 Takenaka et al.
(Continued)

FOREIGN PATENT DOCUMENTS

CN 1228510 9/1999
DE 602004010443 11/2008
(Continued)

OTHER PUBLICATIONS

Office Action issued in China Counterpart Patent Appl. No. 201510132291.4, dated Oct. 10, 2016 , along with an English translation thereof.
(Continued)

*Primary Examiner* — Patrick Hamo
(74) *Attorney, Agent, or Firm* — Greenblum & Bernstein, P.L.C.

(57) ABSTRACT

A rear housing includes a first passage extending from an accommodation chamber towards a communication hole of a valve-forming plate. A cylinder block includes a connection portion to be connected to an external device, an outlet space opening towards the connection portion, and a second passage extending from the outlet space towards the communication hole of the valve-forming plate. A discharge passage includes a discharge chamber, the accommodation chamber, the first passage, the communication hole, the second passage, and the outlet space. The flow passage area of the communication hole is larger than at least one of the flow passage area of the first passage and the flow passage area of the second passage. The discharge passage can be designed with high flexibility.

5 Claims, 5 Drawing Sheets

(51) Int. Cl.
*F04B 39/12* (2006.01)
*F04B 27/18* (2006.01)

(52) U.S. Cl.
CPC .... *F04B 39/122* (2013.01); *F04B 2027/1813* (2013.01); *F04B 2027/1827* (2013.01)

(56) References Cited

U.S. PATENT DOCUMENTS 5,871,337 A * 2/1999 Fukanuma ..... F04B 39/1073 417/222.2
5,899,670 A 5/1999 Ikeda et al.
5,971,716 A * 10/1999 Ota ..... F04B 27/0839 417/222.2
6,015,269 A * 1/2000 Ota ..... F04B 27/109 417/222.2
6,149,397 A * 11/2000 Mizutani ..... F04B 27/1036 417/222.2
6,227,812 B1 * 5/2001 Kawaguchi ..... F04B 27/1804 417/222.2
6,241,483 B1 * 6/2001 Kato ..... F04B 27/1804 417/222.2
6,354,810 B1 3/2002 Minami et al.
6,435,848 B1 * 8/2002 Minami ..... F04B 27/1804 137/514.5
6,568,921 B2 * 5/2003 Dittrich ..... F04B 39/125 417/269
8,323,001 B2 * 12/2012 Kinjo ..... F04B 39/0055 181/232
2004/0016346 A1 * 1/2004 Deubel ..... A23L 2/385 99/275
2004/0161346 A1 8/2004 Hwang et al.
2005/0031456 A1 * 2/2005 Hibino ..... F04B 27/0878 417/222.2
2006/0140785 A1 6/2006 Watanabe et al.
2007/0253837 A1 11/2007 Park et al.
2009/0173094 A1 * 7/2009 Taguchi ..... F04B 27/1804 62/228.5
2009/0246041 A1 * 10/2009 Taguchi ..... F04B 27/1804 417/307
2010/0260621 A1 * 10/2010 Kinjo ..... F04B 39/0055 417/312
2012/0215514 A1 * 8/2012 Anderson ..... G06N 7/005 703/11

FOREIGN PATENT DOCUMENTS

JP 7-189896 7/1995
JP 9-287564 11/1997
JP 10-26080 1/1998
JP 2000-346218 12/2000
JP 2006-77731 3/2006
JP 2007-298039 11/2007

OTHER PUBLICATIONS

Office Action issued in Germany Counterpart Patent Appl. No. 102015104619.9, dated Apr. 27, 2016.

* cited by examiner

COMPRESSOR

This non-provisional application is based on Japanese Patent Application No. 2014-066325 filed on Mar. 27, 2014 with the Japan Patent Office, the entire contents of which are hereby incorporated by reference.

BACKGROUND OF THE INVENTION

Field of the Invention

The present invention relates to a compressor.

Description of the Background Art

A compressor includes a cylinder block, a front housing, a rear housing, and a valve-forming plate or the like. The valve-forming plate is interposed between the cylinder block and the rear housing. The cylinder block forms a compression chamber inside a cylinder bore. The rear housing forms a discharge chamber toward which a refrigerant compressed in the compression chamber is discharged, and an accommodation chamber accommodating a check valve therein and communicating with the discharge chamber through the check valve.

As disclosed in Japanese Patent Laying-Open No. 2000-346218, the compressor includes a discharge passage for delivering the refrigerant compressed in the compression chamber to an external device (a condenser, for example). In the compressor disclosed by the document, the valve-forming plate is formed by an intake valve, a valve plate, a discharge valve and a retainer, and the discharge passage is formed in the rear housing, the valve-forming plate and the cylinder block.

In the case where the discharge passage is formed in the rear housing, the valve-forming plate and the cylinder block, the valve-forming plate is provided with a communication hole functioning as a part of the discharge passage. The rear housing is provided with a passage for communicating the accommodation chamber accommodating the check valve therein with the communication hole formed in the valve-forming plate. The cylinder block is provided with a connection portion to be connected to an external device (a condenser, for example), and another passage for communicating the connection portion with the communication hole formed in the valve-forming plate.

Conventionally, it was difficult to increase flexibility in design of these passages. Specifically, in a conventional compressor, since the communication hole provided in the valve-forming plate has a small dimension (flow passage area), there is only limited installation range (such as the installation angle and the installation position) inside which these passages may communicate with the small communication hole.

An object of the present invention is to provide a compressor capable of achieving a high flexibility in designing a discharge passage.

SUMMARY OF THE INVENTION

A compressor which is provided with a compression chamber and a discharge passage and is configured to deliver a refrigerant compressed in the compression chamber to an external device through the discharge passage includes a cylinder block configured to form the compression chamber, a rear housing configured to form a discharge chamber toward which the refrigerant compressed in the compression chamber is discharged and an accommodation chamber accommodating a check valve therein and communicating with the discharge chamber through the check valve, and a valve-forming plate interposed between the cylinder block and the rear housing and including a communication hole which constitutes a part of the discharge passage. The rear housing includes a first passage extending from the accommodation chamber towards the communication hole of the valve-forming plate. The cylinder block includes a connection portion to be connected to the external device, an outlet space opening towards the connection portion, and a second passage extending from the outlet space towards the communication hole of the valve-forming plate. The discharge passage includes the discharge chamber, the accommodation chamber, the first passage, the communication hole, the second passage, and the outlet space. The flow passage area of the communication hole is larger than at least one of the flow passage area of the first passage and the flow passage area of the second passage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
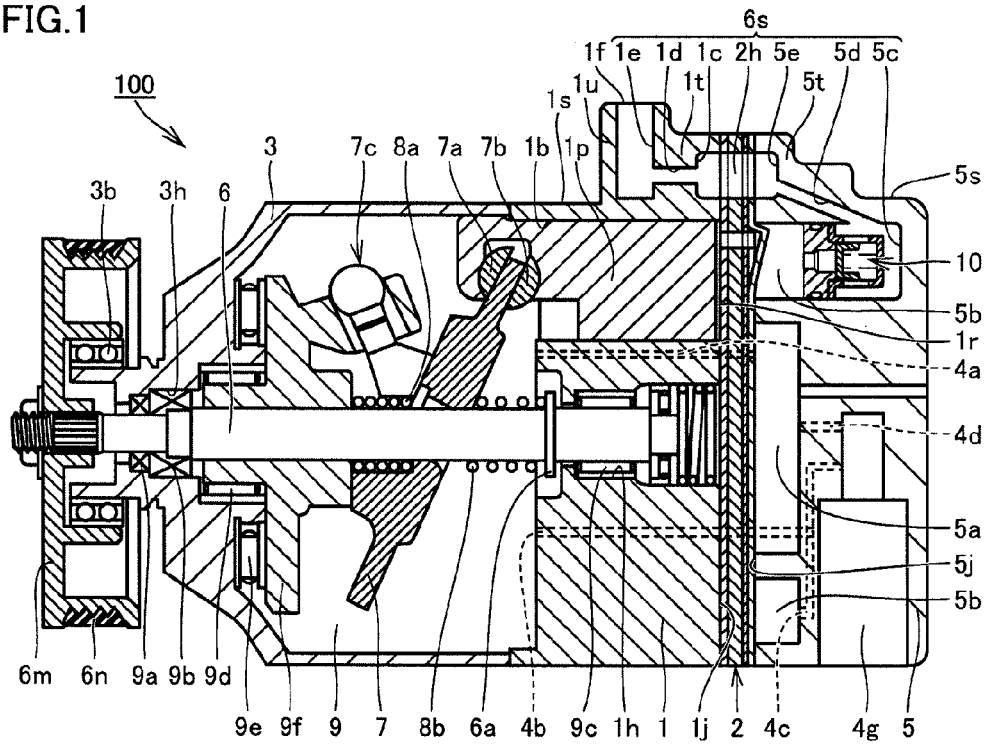
FIG. 1 is a sectional view illustrating a compressor according to a first embodiment.

Embodiments in accordance with the present invention will be described hereinafter with reference to the drawings. Unless otherwise specified, the scope of the present invention is not limited to the number, the amount or the like cited in the embodiments to be described below. The same components and corresponding components are assigned with the same reference numerals, and the description may not be repeated.

First Embodiment (Compressor 100)

FIG. 1 is a sectional view illustrating a compressor 100 according to the first embodiment. The compressor 100 is a swash plate typed compressor having a variable capacity. To be described in detail hereinafter, the compressor 100 includes a compression chamber 1*r* and a discharge passage 6*s*, and is configured to deliver a refrigerant compressed in the compression chamber 1*r* to an external device (such as a condenser) through the discharge passage 6*s*. In the case where the compressor 100 is employed in a vehicular air conditioner for example, the compression chamber 1*r* is connected to the condenser through the discharge passage 6*s*, the condenser is connected to an evaporator through an expansion valve, and the evaporator is connected to a suction chamber (suction chamber 5*a*).

Specifically, the compressor 100 includes a cylinder block 1, a front housing 3, a rear housing 5 and a valve-forming plate 2. The front housing 3 is joined to the front end of the cylinder block 1, and the rear housing 5 is joined to the rear end of the cylinder block 1 through the valve-forming plate 2.

A plurality of cylinder bores 1*b* are formed inside the cylinder block 1. The cylinder block 1 and the front housing 3 form a crank chamber 9. The cylinder block 1 has a shaft hole 1*h*, and the front housing 3 has a shaft hole 3*h*. The shaft holes 1*h* and 3*h* support a drive shaft 6 through the intermediary of a shaft-sealing units 9*a* and shaft-bearing units 9*b* and 9*c*. A pulley 6*m* is installed to the front housing 3 through a bearing device 3*b*. The pulley 6*m* is fixed to the drive shaft 6, and a belt 6*n* driven by a vehicular engine or motor is wound on the pulley 6*m*.

A lug plate 9*f* and a swash plate 7 are provided inside the crank chamber 9. The lug plate 9*f* is press-fitted to the drive shaft 6, and the drive shaft 6 is inserted into and penetrates the swash plate 7. Bearing units 9*d* and 9*e* are provided between the lug plate 9*f* and the front housing 3. An inclination angle-reducing spring 8*a* is provided between the lug plate 9*f* and the swash plate 7. The lug plate 9*f* and the swash plate 7 are connected together by a link mechanism 7*c*.

A circlip 6*a* is fixed to the drive shaft 6. A return spring 8*b* is provided between the circlip 6*a* and the swash plate 7. The plurality of cylinder bores 1*b* each houses therein one piston 1*p*. A pair of shoes 7*a* and 7*b* are provided between each piston 1*p* and the swash plate 7. The wobbling motion of the swash plate 7 is converted into the reciprocating movement of each piston 1*p* by the shoes 7*a* and 7*b*.

The valve-forming plate 2 is interposed between the rear end face of the cylinder block 1 and the front end surface of the rear housing 5. The cylinder bore 1*b* of the cylinder block 1 forms the compression chamber 1*r* between the piston 1*p* and the valve-forming plate 2. The valve-forming plate 2 includes an intake valve, a valve plate, a discharge valve, a retainer and the like, and has a substantially plate-like shape as a whole. To be described in detail hereinafter, the valve-forming plate 2 is provided with a discharge port 2*p* (see FIG. 2) and a suction port (not shown), and a peripheral part (a bulge portion 2*t* illustrated in FIG. 3) of the valve-forming plate 2 is formed with a communication hole 2*h* (see also FIG. 3) which constitutes a part of the discharge passage 6*s*.

A suction chamber 5*a*, a discharge chamber 5*b*, and an accommodation chamber 5*c* are formed inside the rear housing 5. The suction chamber 5*a* is in communication with the compression chamber 1*r* inside the cylinder bore 1*b* through a suction port (not shown) formed to penetrate through the valve-forming plate 2. The crank chamber 9 and the suction chamber 5*a* are connected together by a passage 4*a*. The crank chamber 9 and the discharge chamber 5*b* are connected together by passages 4*b* and 4*c*.

The rear housing 5 houses therein a capacity control valve 4*g*. The capacity control valve 4*g* is in communication with the passages 4*b* and 4*c*, and meanwhile is communication with the suction chamber 5*a* through the intermediary of a pressure detecting passage 4*d*. The capacity control valve 4*g*, based on a detected flow rate differential pressure or the like of the refrigerant gas in the pressure detecting passage 4*d*, controls the passage 4*b* and 4*c* to open or close. The high-pressure refrigerant gas in the discharge chamber 5*b* is supplied to the crank chamber 9 through the passages 4*b* and 4*c*. Adjusting the pressure in the crank chamber 9 to a desired value causes the inclination angle of the swash plate 7 to change, and thereby changes the discharge capacity to a desired one.

Figure 2:
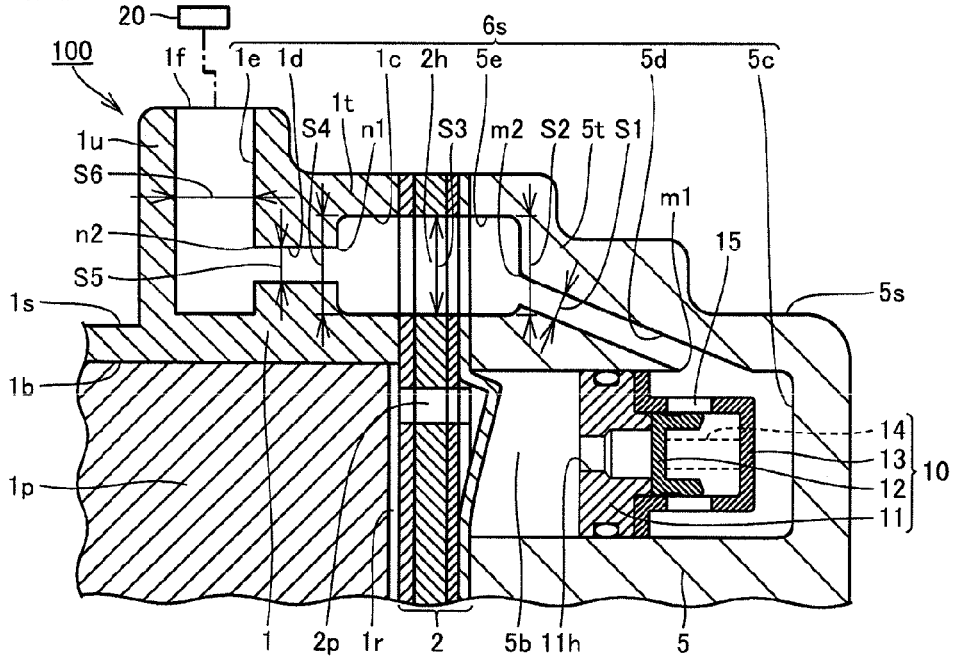
FIG. 2 is a sectional view illustrating an enlarged discharge valve and an enlarged discharge passage of the compressor according to the first embodiment.

The discharge chamber 5*b* within the rear housing 5 is in communication with the compression chamber 1*r* inside the cylinder bore 1*b* through the discharge port 2*p* which is formed to penetrate through the valve-forming plate 2 (see FIG. 2). The accommodation chamber 5*c* is formed adjacent to the discharge chamber 5*b* and accommodates therein the check valve 10. The accommodation chamber 5*c* (specifically, a part of the accommodation chamber 5*c* located downstream than the check valve 10) communicates with the discharge chamber 5*b* through the check valve 10.

(Check Valve 10)

FIG. 2 is a sectional view illustrating the enlarged check valve 10 and the enlarged discharge passage 6*s*. The check valve 10 is provided with a valve seat 11, a valve body 12, a valve housing 13 and a spring 14, and is press-installed inside the accommodation chamber 5*c*. The valve seat 11 has a valve hole 11*h*. The valve body 12 is configured to close the valve hole 11*h* when being moved in the valve housing 13 along the direction towards the valve seat 11, and to open the valve hole 11*h* when being moved in the valve housing 13 along the direction away from the valve seat 11.

The valve housing 13 houses therein a spring 14 urging the valve body 12 towards the valve-closing direction. A side wall of the valve housing 13 is formed with a communication window 15. When the valve is opened, the refrigerant from the valve hole 11*h* flows into the accommodation chamber 5*c* (specifically, a part of the accommodation chamber 5*c* located downstream than the check valve 10) through the communication window 15.

(Discharge Passage 6*s*)

Figure 3:
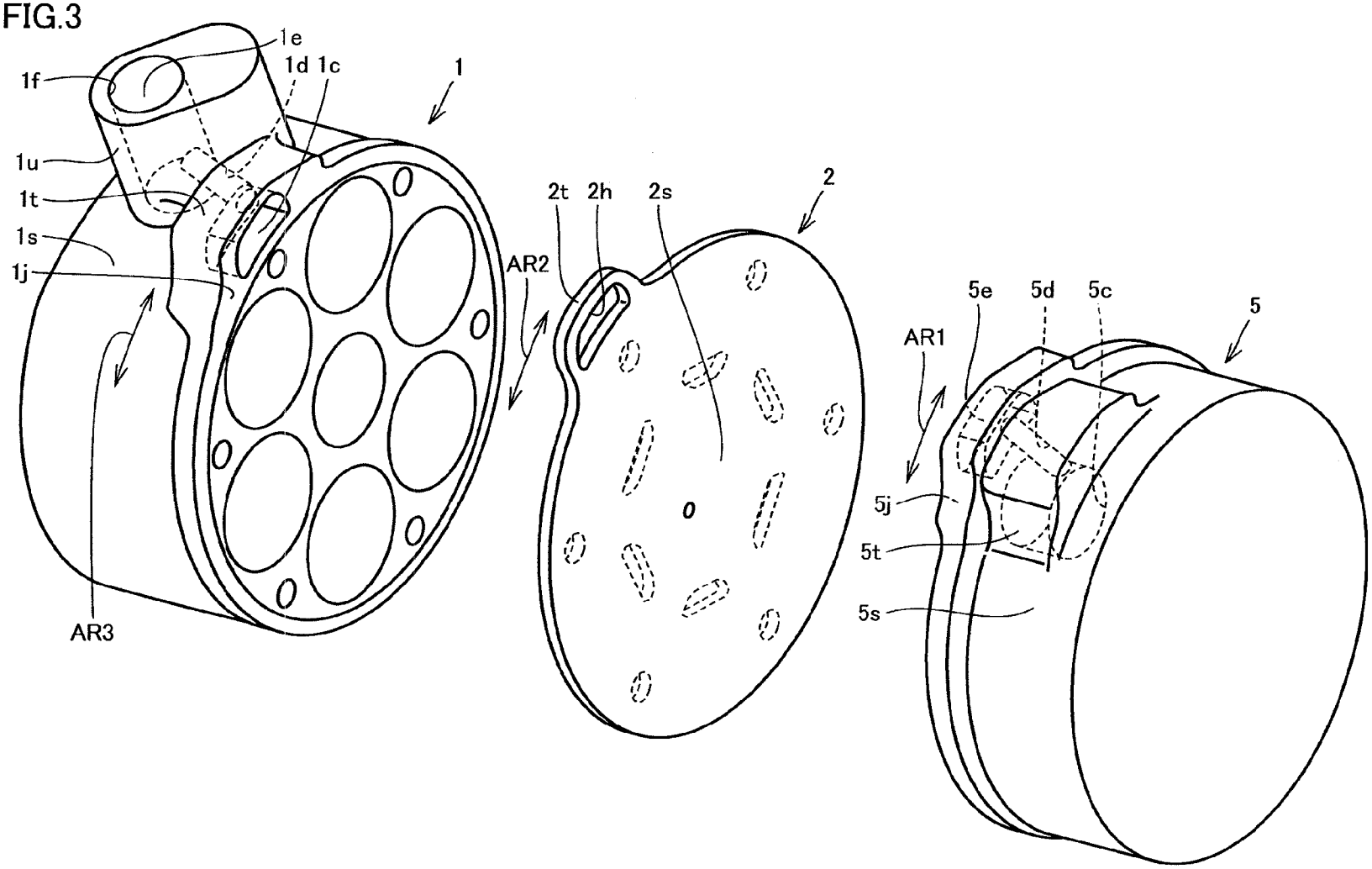
FIG. 3 is a perspective view illustrating a cylinder block, a valve-forming plate and a rear housing of the compressor according to the first embodiment in an exploded state.

FIG. 3 is a perspective view illustrating the cylinder block 1, the valve-forming plate 2 and the rear housing 5 in an exploded state. The valve-forming plate 2 in FIG. 3 is illustrated as a single plate for the purpose of clarity and convenience in the drawing, and in fact, the valve-forming plate 2 includes the intake valve, the valve plate, the discharge valve, the retainer and the like (see FIG. 2).

(First Passage 5*d* and First Space 5*e*)

Referring to FIGS. 2 and 3, the rear housing 5 has an outer peripheral surface 5*s*. The rear housing 5 is provided with a bulge portion 5*t* bulging outward (radially outward). In the part where the bulge portion 5*t* is formed, the outer peripheral surface 5*s* of the rear housing 5 has a shape that bulges convexly outward (radially outward). In the other part where the bulge portion 5*t* is not formed, the outer peripheral surface 5*s* of the rear housing 5 has a cylindrical shape.

The bulge portion 5*t* constitutes a part of the rear housing 5, and is integrally formed with the part of the rear housing 5 that forms the discharge chamber 5*b* and the accommodation chamber 5*c*. A first passage 5*d* and a first space 5*e* are formed inside the bulge portion 5*t*. The part of the rear housing 5 that forms the discharge chamber 5*b* and the accommodation chamber 5*c* and the part of the rear housing 5 that forms the first passage 5*d* and the first space 5*e* are made of the same material (aluminum-based metal or the like).

The first passage 5*d* and the first space 5*e* communicate with each other, and the first space 5*e* is located at the downstream of the first passage 5*d* in the flowing direction of the refrigerant. The first passage 5*d* has for example a cylindrical shape, and extends towards a part where the communication hole 2*h* of the valve-forming plate 2 to be described later is formed. The upstream end m1 (see FIG. 2) of the first passage 5*d* opens towards the accommodation chamber 5*c*, and the downstream end m2 (see FIG. 2) of the first passage 5*d* opens towards the first space 5*e*.

The part of the rear housing 5 that forms the first space 5*e* has a bottomed cylindrical shape. The first space 5*e* is formed into a concave shape through a cutting process or the like performed on a part of an end face 5*j* (see FIG. 3) of the rear housing 5 that joins to the valve-forming plate 2. In the case where the rear housing 5, the valve-forming plate 2 and the like are in an exploded state (the state illustrated in FIG. 3), the first space 5*e* has an opening in the end face 5*j*. In the present embodiment, the first space 5*e* is formed into a substantially cubic space extending in the direction indicated by an arrow AR1 (see FIG. 3), and the flow passage area S2 of the first space 5*e* (see FIG. 2) is larger than the flow passage area S1 of the first passage 5*d* (see FIG. 2). The direction indicated by the arrow AR1 corresponds to the circumferential direction of the rear housing 5.

(Communication Hole 2*h*)

As illustrated in FIG. 3, the valve-forming plate 2 includes a disc portion 2*s* (circular portion) and a bulge portion 2*t* (another bulge portion) bulging outward (radially outward) from the outer peripheral edge of the disc portion 2*s*. In the part where the bulge portion 2*t* is formed, the outer peripheral edge of the valve-forming plate 2 has a shape that bulges convexly outward (radially outward). In the other part where the bulge portion 2*t* is not formed, the outer peripheral edge of the valve-forming plate 2 has a circular shape.

The communication hole 2*h* is formed inside the bulge portion 2*t*. In the present embodiment, the communication hole 2*h* is formed into a substantially cubic space extending in the direction indicated by an arrow AR2 (see FIG. 3). The direction indicated by the arrow AR2 corresponds to the circumferential direction of the valve-forming plate 2. The communication hole 2*h* and the first space 5*e* have substantially the same outer edge shape, and the flow passage area S3 of the communication hole 2*h* (see FIG. 2) is substantially the same as the flow passage area S2 of the first space 5*e* (see FIG. 2). In other words, the flow passage area S3 of the communication hole 2*h* is larger than the flow passage area S1 of the first passage 5*d*.

(Second Space 1*c*, Second Passage 1*d* and Outlet Space 1*e*)

Referring to FIGS. 2 and 3, the cylinder block 1 has an outer peripheral surface 1*s*. The cylinder block 1 is provided with a bulge portion 1*t* that bulges outward (radially outward) and a bulge portion 1*u* that bulges outward further than the bulge portion 1*t*. In the part where the bulge portions 1*t* and 1*u* are formed, the outer peripheral surface 1*s* of the cylinder block 1 has a shape that bulges convexly outward (radially outward). In the other part where the bulge portions 1*t* and 1*u* are not formed, the outer peripheral surface 1*s* of the cylinder block 1 has a cylindrical shape.

The bulge portions 1*t* and 1*u* constitute a part of the cylinder block 1, and are integrally formed with the part of the cylinder block 1 that forms the cylinder bores 1*b*. A second space 1*c* and a second passage 1*d* are formed inside the bulge portion 1*t* of the cylinder block 1. An outlet space 1*e* is formed inside the bulge portion 1*u*. The part of the cylinder block 1 that forms the cylinder bores 1*b* and the part of the cylinder block 1 that forms the second space 1*c*, the second passage 1*d* and the outlet space 1*e* are made of the same material (aluminum-based metal or the like).

The second space 1*c*, the second passage 1*d* and the outlet space 1*e* communicate with each other. In the flowing direction of the refrigerant, the second space 1*c* is located at the upstream of the second passage 1*d*, and the outlet space 1*e* is located at the downstream of the second passage 1*d*. The second passage 1*d* and the outlet space 1*e* each has for example a cylindrical shape. The second passage 1*d* extends from the outlet space 1*e* towards the part of the valve-forming plate 2 where the communication hole 2*h* is formed. The upstream end n1 (see FIG. 2) of the second passage 1*d* opens towards the second space 1*c*, and the downstream end n2 (see FIG. 2) of the second passage 1*d* opens towards the outlet space 1*e*. The downstream end of the outlet space 1*e* opens towards a connection portion 1*f*. The connection portion 1*f* is a site to be connected to an external device 20 (see FIG. 2) such as a condenser.

The part of the cylinder block 1 that forms the second space 1*c* has a bottomed cylindrical shape. The second space 1*c* is formed into a concave shape through a cutting process or the like performed on a part of an end face 1*j* (see FIG. 3) of the cylinder block 1 that joins to the valve-forming plate 2. In the case where the cylinder block 1, the valve-forming plate 2 and the like are in an exploded state (the state illustrated in FIG. 3), the second space 1*c* has an opening in the end face 1*j*. In the present embodiment, the second space 1*c* is formed into a substantially cubic space extending in the direction indicated by an arrow AR3 (see FIG. 3), and the flow passage area S4 of the second space 1*c* (see FIG. 2) is larger than the flow passage area S5 of the second passage 1*d* (see FIG. 2). The direction indicated by the arrow AR3 corresponds to the circumferential direction of the cylinder block 1. In the present embodiment, the flow passage area S4 of the second space 1*c* (see FIG. 2) is substantially the same as the flow area S3 of the communication hole 2*h* (see FIG. 2). In other words, the flow passage area S3 of the communication hole 2*h* is larger than the flow passage area S5 of the second passage 1*d*.

The part of the cylinder block 1 that forms the outlet space 1*e* also has a bottomed cylindrical shape. The outlet space 1*e* is formed into a concave shape through a cutting process or the like performed on a part of the end face of the cylinder block 1 that forms the connection portion 1*f*. In a state where the external device 20 is detached (through detaching a connection pipe or the like) from the connection portion 1*f*, the outlet space 1*e* has an opening in the connection portion 1*f*. In the present embodiment, the outlet space 1*e* is formed into a substantially cylindrical space, and the flow passage area S6 of the outlet space 1*e* (see FIG. 2) is larger than the flow passage area S5 of the second passage 1*d* (see FIG. 2).

Referring again to FIGS. 1 and 2, the discharge passage 6*s* in the present embodiment includes the discharge chamber 5*b*, the accommodation chamber 5*c*, the first passage 5*d*, the first space 5*e*, the communication hole 2*h*, the second space 1*c*, the second passages 1*d*, and the outlet space 1*e*. The compressor 100 is configured to deliver the refrigerant compressed in the compression chamber 1*r* to an external device (such as a condenser) through the discharge passage 6*s*, and thereby it can function as for example a part of the refrigerant circuit.

(Functions and Effects)

Figure 4:
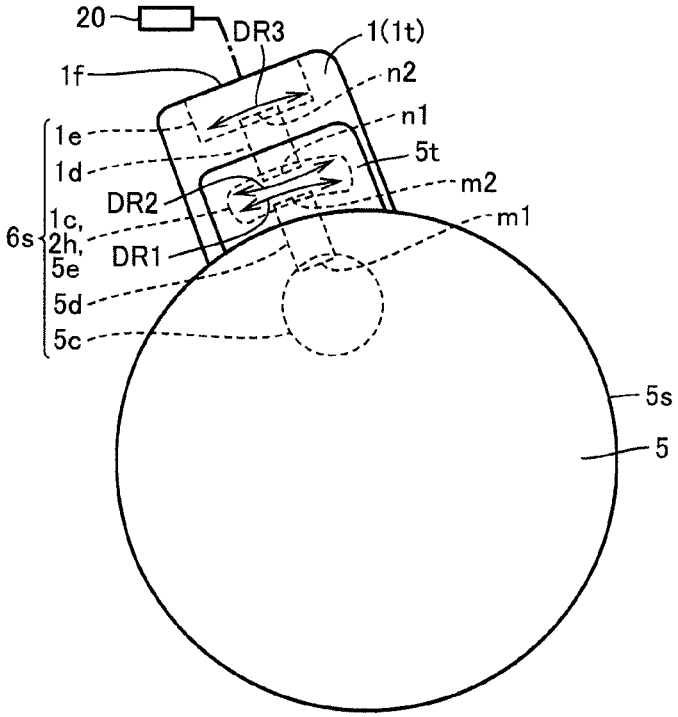
FIG. 4 is a bottom view schematically illustrating the compressor according to the first embodiment.

FIG. 4 is a bottom view schematically illustrating the compressor 100, and the compressor 100 is illustrated as being viewed from the side of the rear housing 5. The external device 20 such as a condenser or the like is connected to the connection portion 1*f* of the compressor 100 through a connection pipe. The position to dispose the external device 20 may be changed according to, for example, the specifications of the external device 20 and/or the specifications of a vehicle where the compressor 100 and the external device 20 are mounted. Since it is possible for the compressor 100 of the present embodiment to achieve a high flexibility in designing the discharge passage 6*s*, it can flexibly cope with the changes in the abovementioned specifications, which will be described in detail hereinafter.

As described in the above, the flow passage area S3 of the communication hole 2*h* (see FIG. 2) provided in the valve-forming plate 2 is larger than the flow passage area S1 of the first passage 5*d* (see FIG. 2) provided in the rear housing 5. As illustrated in FIG. 4, when providing the first passage 5*d* in the rear housing 5, the downstream end m2 of the first passage 5*d* (see also FIG. 2) can be freely positioned within the range indicated by an arrow DR1. Even though the downstream end m2 of the first passage 5*d* is positioned within the range indicated by the arrow DR1, as long as the downstream end m2 of the first passage 5*d* is opened towards the communication hole 2*h*, it is possible for the first passage 5*d* to communicate the accommodation chamber 5*c* with the communication hole 2*h*. Therefore, since the downstream end m2 of the first passage 5*d* can be freely positioned within the range indicated by the arrow DR1, the installation range (such as the installation angle and the installation position) of the first passage 5*d* for communicating with the communication hole 2*h* can be widened, and thereby it is possible to achieve a high flexibility in designing the discharge passage 6*s*.

Similarly, the flow passage area S3 of the communication hole 2*h* (see FIG. 2) provided in the valve-forming plate 2 is larger than the flow passage area S5 of the second passage 1*d* (see FIG. 2) provided in the bulge portion 1*t* of the cylinder block 1. As illustrated in FIG. 4, when providing the second passage 1*d* in the cylinder block 1, the upstream end n1 of the second passage 1*d* (see also FIG. 2) can be freely positioned within the range indicated by an arrow DR2. Even though the upstream end n1 of the second passage 1*d* is positioned within the range indicated by the arrow DR2, as long as the upstream end n1 of the second passage 1*d* is opened towards the communication hole 2*h*, it is possible for the second passage 1*d* to communicate the communication hole 2*h* with the outlet space 1*e* (connection portion 1*f*). Therefore, since the upstream end n1 of the second passage 1*d* can be freely positioned within the range indicated by the arrow DR2, the installation range (such as the installation angle and the installation position) of the second passage 1*d* for communicating with the communication hole 2*h* can be widened, and thereby it is possible to achieve a high flexibility in designing the discharge passage 6*s*.

In the present embodiment, the flow passage area S6 of the outlet space 1*e* (see FIG. 2) is larger than the flow passage area S5 of the second passage 1*d* (see FIG. 2). As illustrated in FIG. 4, when providing the second passage 1*d* in the cylinder block 1, the downstream end n2 of the second passage 1*d* (see also FIG. 2) can be freely positioned within the range indicated by an arrow DR3. Even though the downstream end n2 of the second passage 1*d* is positioned within the range indicated by the arrow DR3, as long as the downstream end n2 of the second passage 1*d* is opened towards the outlet space 1*e*, it is possible for the second passage 1*d* to communicate the communication hole 2*h* with the outlet space 1*e* (connection portion 1*f*). Therefore, since the downstream end n2 of the second passage 1*d* can be freely positioned within the range indicated by the arrow DR3, the installation range (such as the installation angle and the installation position) of the second passage 1*d* for communicating with the communication hole 2*h* can be widened, and thereby it is possible to achieve a high flexibility in designing the discharge passage 6*s*.

Figure 5:
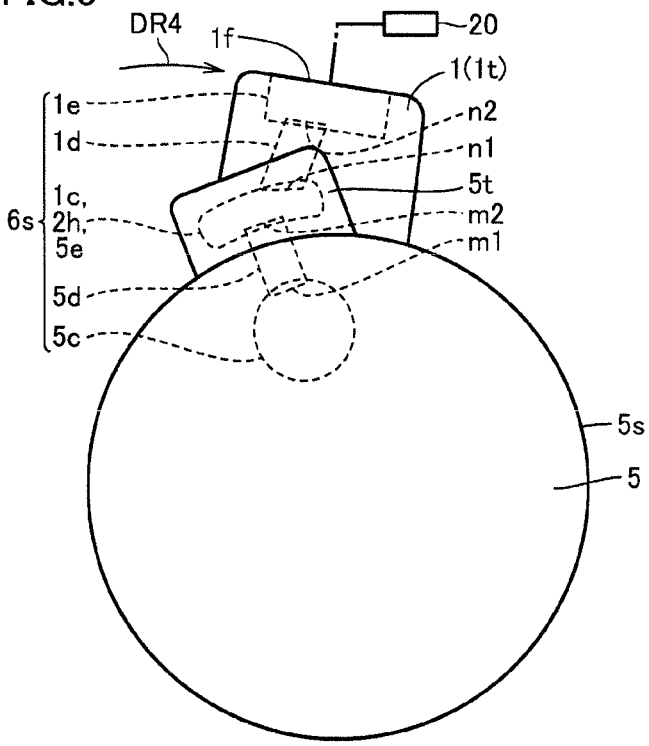
FIG. 5 is a bottom view for explaining the functions and effects of the compressor according to the first embodiment.

As illustrated in FIG. 5, for example, even in the case where it is necessary to change the position of the connection portion 1*f* along direction indicated by an arrow DR4, it is possible for the rear housing 5 and the valve-forming plate 2 (not shown) to share a common structure illustrated in FIG. 4. Similarly, even in the case where it is necessary to change the position of the accommodation chamber 5*c* in accordance with the specifications of the rear housing 5, it is possible for the cylinder block 1 and the valve-forming plate 2 (not shown) to share a common structure illustrated in FIG. 4. Therefore, the adoption of the ideas contained in the compressor 100 improves the versatility of components, which thereby makes it possible to reduce the manufacturing cost.

In the present embodiment, the first space 5*e* (see FIG. 2) is provided between the communication hole 2*h* and the first passage 5*d*. The flow passage area S2 of the first space 5*e* (see FIG. 2) is larger than the flow passage area S1 of the first passage 5*d* (see FIG. 2). The refrigerant contracts and expands when passing through the accommodation chamber 5*c*, the first passage 5*d* and the first space 5*e*. Thus, the accommodation chamber 5*c*, the first passage 5*d* and the first space 5*e* can function as a muffler chamber.

In the present embodiment, the second space 1*c* (see FIG. 2) is provided between the communication hole 2*h* and the second passage 1*d*, and the outlet space 1*e* (see FIG. 2) is provided between the connection portion 1*f* and the second passage 1*d*. The flow passage area S4 of the second space 1*c* (see FIG. 2) is larger than the flow passage area S5 of the second passage 1*d* (see FIG. 2). The flow passage area S6 of the outlet space 1*e* (see FIG. 2) is larger than the flow passage area S5 of the second passage 1*d* (see FIG. 2). The refrigerant contracts and expands when passing through the second space 1*c*, the second passage 1*d* and the outlet space 1*e*. Thus, the second space 1*c*, the second passage 1*d* and the outlet space 1*e* can function as a muffler chamber.

In the present embodiment, the compressor 100 is provided with a bulge portion (bulge portion 1*t*, 2*t* and/or 5*t*) that bulges outward, and the communication hole 2*h* provided in the valve-forming plate 2 is located within the bulge portion. The bulge portion 1*t* is formed integral with the cylinder block 1, and the bulge portion 5*t* is formed integral with the rear housing 5. According to this configuration, compared with the case where a member is provided separately so as to join the bulge portion to the cylinder block 1 and/or the rear housing 5, it is possible to reduce the manufacturing cost.

Second Embodiment

Figure 6:
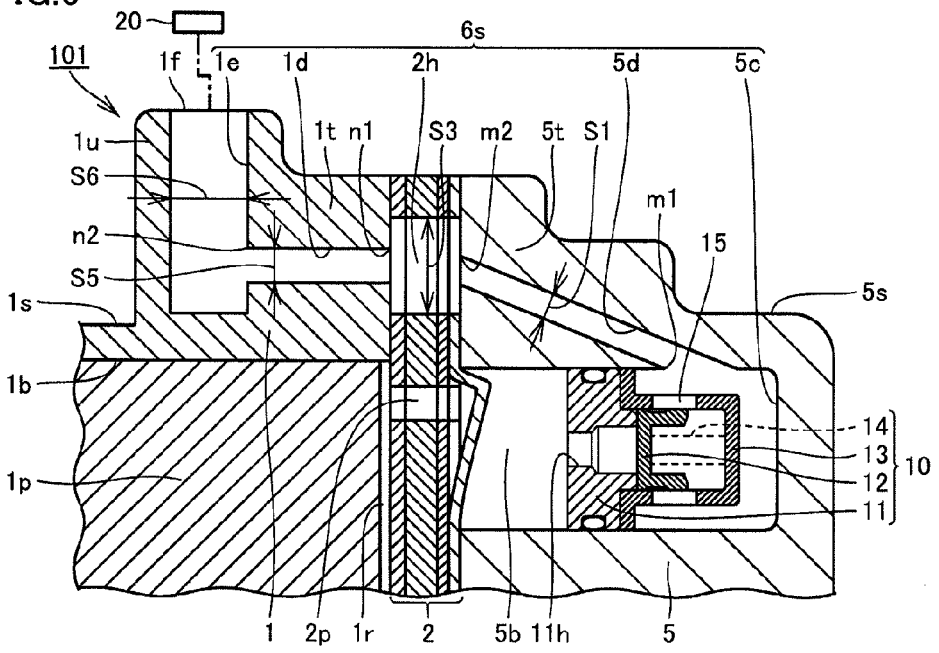
FIG. 6 is a sectional view illustrating an enlarged discharge passage of a compressor according to a second embodiment.

In a compressor 101 illustrated in FIG. 6, the first space 5*e* (see FIG. 2) is not formed in the rear housing 5, and the second space 1*c* (see FIG. 2) is not formed in the cylinder block 1. The first passage 5*d* formed in the rear housing 5 is in direct communication with the communication hole 2*h* of the valve-forming plate 2, and second passage 1*d* formed in the cylinder block 1 is also in direct communication with the communication hole 2*h* of the valve-forming plate 2.

In the compressor 101, the flow passage area S3 of the communication hole 2*h* is larger than the flow passage area S1 of the first passage 5*d*, and the flow passage area S3 of the communication hole 2*h* is also larger than the flow passage area S5 of the second passage 1*d*. According to this configuration, since the installation range (such as the installation angle and the installation position) for communicating the first passage 5*d* and the second passage 1*d* with the communication hole 2*h* can be widened, it is possible to achieve a high flexibility in designing the discharge passage 6*s*. In addition to the configuration of the second embodiment, similar to the first embodiment, the first space 5*e* may be formed in the rear housing 5. In addition to the configuration of the second embodiment, similar to the first embodiment, the second space 1*c* may be formed in the cylinder block 1.

Third Embodiment

Figure 7:
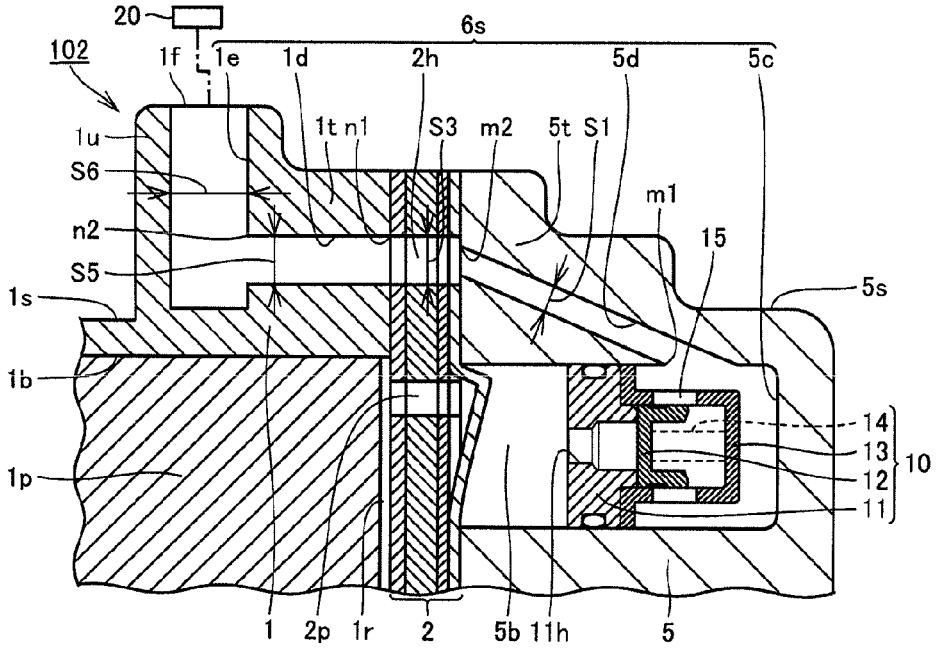
FIG. 7 is a sectional view illustrating an enlarged discharge passage of a compressor according to a third embodiment.

In a compressor 102 illustrated in FIG. 7, the flow passage area S3 of the communication hole 2*h* is not configured as being larger than the flow passage area S5 of the second passage 1*d*. However, the flow passage area S3 of the communication hole 2*h* is configured as being larger than the flow passage area S1 of the first passage 5*d*. According to this configuration, since the installation range (such as the installation angle and the installation position) for communicating the first passage 5*d* with the communication hole 2*h* can be widened, it is possible to achieve a high flexibility in designing the discharge passage 6*s*.

Fourth Embodiment

Figure 8:
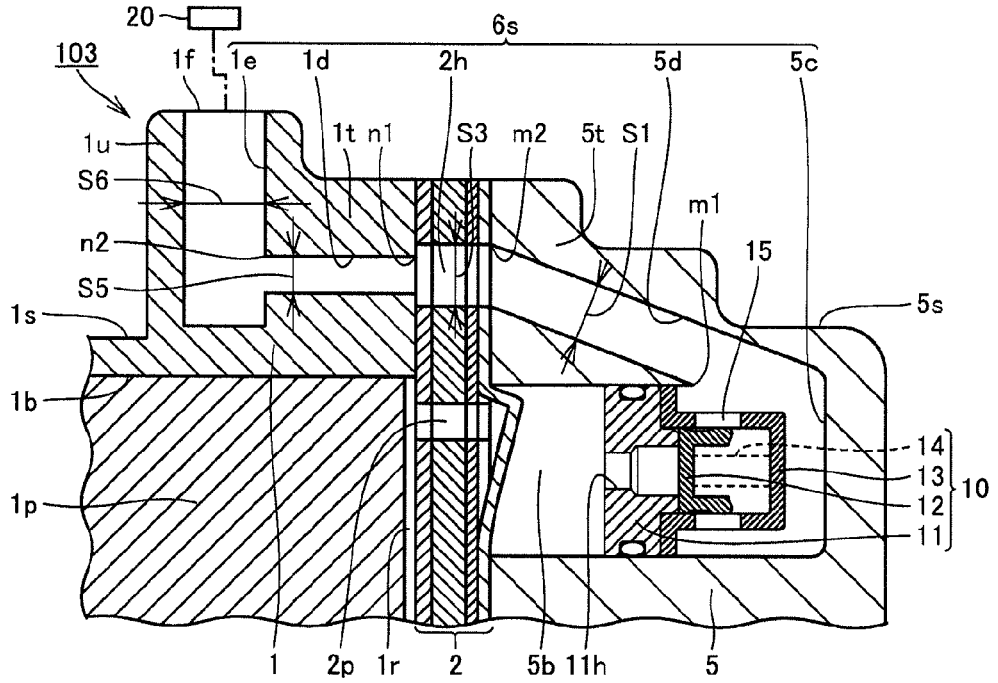
FIG. 8 is a sectional view illustrating an enlarged discharge passage of a compressor according to a fourth embodiment.

In a compressor 103 illustrated in FIG. 8, the flow passage area S3 of the communication hole 2*h* is not configured as being larger than the flow passage area S1 of the first passage 5*d*. However, the flow passage area S3 of the communication hole 2*h* is configured as being larger than the flow passage area S5 of the second passage 1*d*. According to this configuration, since the installation range (such as the installation angle and the installation position) for communicating the second passage 1*d* with the communication hole 2*h* can be widened, it is possible to achieve a high flexibility in designing the discharge passage 6*s*.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A compressor which is provided with a compression chamber and a discharge passage and is configured to deliver a refrigerant compressed in said compression chamber to an external device through said discharge passage, comprising:

a cylinder block configured to form said compression chamber;

a rear housing configured to form a discharge chamber toward which the refrigerant compressed in said compression chamber is discharged and an accommodation chamber accommodating a check valve therein and communicating with said discharge chamber through said check valve; and a valve-forming plate interposed between said cylinder block and said rear housing, and including a communication hole which constitutes a part of said discharge passage, said rear housing including a first passage extending from said accommodation chamber towards said communication hole of said valve-forming plate, said cylinder block including a connection portion to be connected to said external device, an outlet space opening towards said connection portion, and a second passage extending from said outlet space towards said communication hole of the valve-forming plate, said discharge passage including said discharge chamber, said accommodation chamber, said first passage, said communication hole, said second passage, and said outlet space, and the flow passage area of said communication hole being larger than at least one of the flow passage area of said first passage and the flow passage area of said second passage, wherein at least one of said cylinder block and said rear housing includes a main bulge portion bulging outward from an outer periphery thereof, wherein said valve-forming plate includes a circular portion and a cooperating bulge portion that bulges from an outer peripheral edge of the circular portion, said main bulge portion and said cooperating bulge portion being aligned in a circumferential direction of said cylinder block, the communication hole being formed in the cooperating bulge portion and having an elongated shape, wherein a longitudinal axis of the elongated shape extends in a circumferential direction of said valve-forming plate, wherein said first passage is formed so as to be inclined with respect to a planar surface of the valve-forming plate, and wherein a central axis of said first passage extends transverse to a central axis of said second passage.

2. The compressor according to claim 1, wherein said rear housing further includes a first space which is provided at the downstream of said first passage and communicates with said communication hole, and the flow passage area of said first space is larger than the flow passage area of said first passage.

3. The compressor according to claim 1, wherein said cylinder block further includes a second space which is provided at the upstream of said second passage and communicates with said communication hole, and the flow passage area of said second space is larger than the flow passage area of said second passage.

4. The compressor according to claim 1, wherein the flow passage area of said outlet space is larger than the flow passage area of said second passage.

5. The compressor according to claim 1, further comprising:

the main bulge portion having a first opposing bulge portion and a second opposing bulge portion, wherein the first opposing bulge portion is provided on said rear housing and the second opposing bulge portion is provided on said cylinder block, wherein the cooperating bulge portion of the valve-forming plate is interposed between the first opposing bulge portion and the second opposing bulge portion, and wherein said first passage is formed in the first opposing bulge portion and said second passage is formed in the second opposing bulge portion.

* * * * *